US005824399A

United States Patent [19]

Denton et al.

[11] Patent Number: 5,824,399

[45] **Date of Patent: *Oct. 20, 1998**

[54] MULTILAYERED THERMAL TRANSFER MEDIUM WITH OPAQUE SUB-COAT

[75] Inventors: Jeffery S. Denton, Miamisburg; Michael W. Olmstead, West Carrollton, both of Ohio

[73] Assignee: NCR Corporation, Dayton, Ohio

[ * ] Notice: The term of this patent shall not extend beyond the expiration date of Pat. No. 5,744,226.

[21] Appl. No.: 671,049

[22] Filed: Jun. 27, 1996

[51] Int. Cl.[6] ..... B41M 5/26

[52] U.S. Cl. ..... 428/212; 428/195; 428/219; 428/341; 428/484; 428/488.1; 428/488.4; 428/913; 428/914

[58] Field of Search ..... 428/195, 484, 428/488.1, 488.4, 913, 522, 480, 212, 219, 341, 914

[56] References Cited

U.S. PATENT DOCUMENTS

| | | |
|---|---|---|
| 3,663,278 | 5/1972 | Blose et al. . |
| 4,315,643 | 2/1982 | Tokunaga et al. . |
| 4,403,224 | 9/1983 | Wirnowski . |
| 4,463,034 | 7/1984 | Tokunaga . |
| 4,628,000 | 12/1986 | Talvalkar et al. . |
| 4,687,701 | 8/1987 | Knirsch et al. . |
| 4,698,268 | 10/1987 | Ueyama . |
| 4,707,395 | 11/1987 | Ueyama et al. . |
| 4,777,079 | 10/1988 | Nagamoto et al. . |
| 4,778,729 | 10/1988 | Mizobuchi . |
| 4,894,283 | 1/1990 | Wehr . |
| 4,923,749 | 5/1990 | Talvalkar . |
| 4,988,563 | 1/1991 | Wehr . |
| 5,240,781 | 8/1993 | Obata et al. . |
| 5,348,348 | 9/1994 | Hanada et al. . |

*Primary Examiner*—Pamela R. Schwartz
*Attorney, Agent, or Firm*—Richard J. Traverso

[57] ABSTRACT

A thermal transfer medium is provided which is sufficiently opaque to be sensed by optical sensing means, yet forms images which can be transparent or semi-transparent (or opaque). The thermal transfer medium comprises a transparent substrate and multi-layer structure of a thin first coat and a thick second coating. The coatings are formulated such that only the second coating transfers to a receiving substrate upon exposure to a print head of a thermal printer leaving the first coat positioned on the transparent substrate. Separation of the two coatings allows the transparency/opacity of the image to be independent of the transparency/opacity of the first coats and the thermal transfer medium.

14 Claims, 1 Drawing Sheet

MULTILAYERED THERMAL TRANSFER MEDIUM WITH OPAQUE SUB-COAT

RELATED CO-PENDING APPLICATION

This application relates to U.S. Pat. No. 5,244,226, of Olmstead et al., and assigned to the same assignee as the present invention. This application also relates to application Ser. No. 08/671,852 of Roth et al., and assigned to the same assignee as the present invention.

FIELD OF THE INVENTION

The present invention relates to thermal transfer printing technology wherein data or images are produced on a receiving substrate by selectively transferring portions of a pigmented layer from a donor film to the receiving substrate by heating extremely precise areas with thin film resistors.

BACKGROUND OF THE INVENTION

Thermal transfer printing is widely used in special applications such as in the printing of machine readable bar codes, either on labels or directly on articles to be encoded. The thermal transfer process employed by these printing methods provides great flexibility in generating images allowing for broad variation in the style, size and color of the printed images, typically from a single machine with a single thermal print head.

Representative documentation in the area of thermal transfer printing include the following patents:

U.S. Pat. No. 3,663,278, issued to J. H. Blose et al. on May 16, 1972, which discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama et al. on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mizobuchi on Oct. 18, 1988, discloses a heat transfer sheet comprising a hot melt ink layer on one surface of a film and a filling layer laminated on the ink layer.

U.S. Pat. No. 4,894,283, issued to Wehr on Jan. 16, 1990, discloses a reusable thermal transfer ribbon with a functional layer and a binding layer containing 100% ethylene vinyl acetate copolymer.

U.S. Pat. No. 4,923,749, issued to Talvalkar on May 8, 1990, discloses a thermal transfer ribbon which has a thermal sensitive layer and a protective layer which is water based.

And, U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

Thermal transfer printers are equipped with ribbon sensors to let the printer know when there is or is not a ribbon present in the machine. Ribbons with some opacity are required to operate these machines. However, many thermal transfer ribbons are transparent, especially those with a transparent substrate and transparent thermal transfer layer (functional layer). In addition, many thermal transfer ribbons with a thermal transfer layer of a color other than black are fairly transparent (semi-transparent) and will not be "seen" by the sensors. This limits the use of certain printers to certain ribbons. One alternative is to reformulate the transparent colored ribbons to include components that will enable the ribbon to be sensed by the printer. Although technically possible, such a solution is not practical due to the expense of reformulating the ribbons and maintaining/handling separate inventories of ribbon in use. It is desirable to provide a thermal transfer ribbon which has transparent or semi-transparent functional layers which can be "seen" by various ribbon sensors of printers without reformulation of the thermal transfer layer (functional layer).

SUMMARY OF THE INVENTION

It is an object of the present invention to provide a thermal transfer medium such as a thermal transfer ribbon with sufficient opacity to be "sensed" by optical sensors of a thermal transfer printer independent of whether the functional layer is opaque, transparent or semi-transparent which provides corresponding opaque, transparent or semi-transparent images.

It is another object of the present invention to provide a thermal transfer medium such as a thermal transfer ribbon which provides high quality transparent or semi-transparent images and exhibits sufficient opacity to be "sensed" by various optical sensors of various thermal printers without reformulating the functional coating, altering the structure of the thermal transfer medium or altering the configuration of the thermal transfer medium.

A further object of the present invention is to provide a multi-layered thermal transfer ribbon with a transparent polyester substrate and a thermally sensitive sub-coat (first coating) that provides opacity to the thermal transfer ribbon but does not transfer when exposed to the thermal print head of a thermal printer.

It is a further object of the present invention to provide thermal transfer ribbons which are opaque yet comprise a transparent substrate and a transparent or semi-transparent functional layer.

Additional objects and advantages of the present invention will become apparent and further understood from the detailed description and claims which follow, together with the annexed drawings.

The above objects are achieved through the thermal transfer medium of the present invention which comprises a) a transparent flexible substrate; b) a thermally sensitive sub-coating (first coating) positioned on said substrate comprising a dark-colored pigment, a binder resin, and preferably having a coat weight of from 0.39–1.94 g/m$^2$; and c) a thermally sensitive functional coating (second coating) positioned on said first coating having a coat weight of from 1.94 to 6 g/m$^2$ and comprising a binder resin, wax and optionally a pigment or dye. The second coating may be opaque, transparent or semi-transparent. The first coating and second coating are formulated so that the first coating has a softening point higher than that of the second coating. In addition, the first coating preferably has at least 40 weight percent binder resin, based on dry components and the second coating has at least 40 weight percent wax based on dry components. In preferred embodiments, the first coating contains at least 50 weight percent resin binder and less than 50 weight percent wax to enhance adhesion to the flexible substrate.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
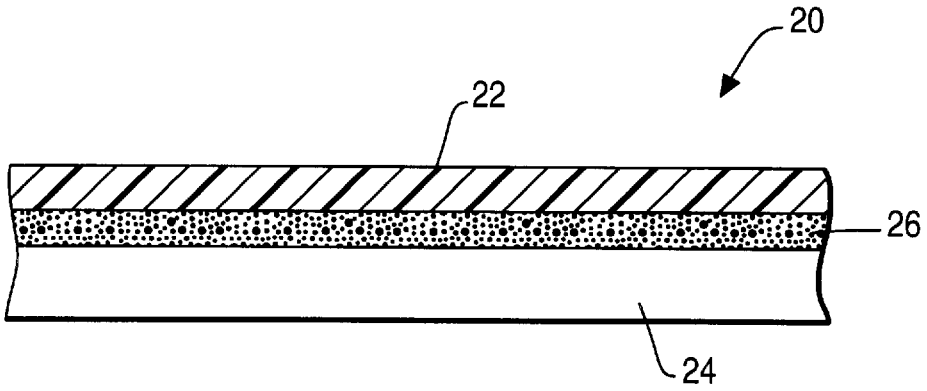
FIG. 1 illustrates a thermal transfer medium of the present invention prior to thermal transfer.
Figure 2:
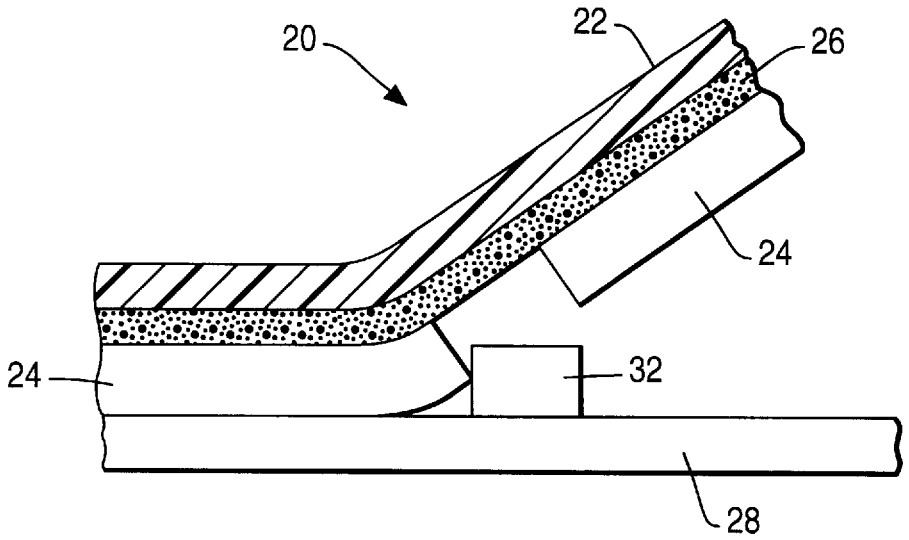
FIG. 2 illustrates a thermal transfer medium of the present invention after thermal transfer.

Thermal transfer ribbon 20, as illustrated in FIGS. 1 and 2, is a preferred embodiment of this invention comprising a substrate 22 of a transparent flexible material, preferably a thin smooth plastic-like material. Polyester-type plastic materials are preferred such as 14–35 gauge polyester film manufactured by Dupont under the trademark Mylar® are suitable. Polyethylene naphthalate films, polyamide films such as nylon, polyolefin films such as polypropylene film, cellulose films which are transparent such as triacetate film and polycarbonate films are also suitable. In addition to being transparent, the substrates should have high tensile strength to provide ease in handling and coating and preferably provide these properties at minimum thickness and low heat resistance to prolong the life of heating elements within thermal print heads. The thickness is preferably 3 to 50 microns. If desired, the substrate or base film may be provided with a silicone backcoating on the surface opposite the thermal transfer layer. This backcoating is typically transparent.

Positioned on substrate 22 is a sub-coating 26 also referred to herein as a "first coating". The first coating contains a binder resin, a dark-colored colorant and optionally wax. The thermal transfer ribbon 20 also has a thermally sensitive functional coating (second coating) 24 positioned on sub-coating 26 which contains a wax, binder resin and optionally a pigment or dye. The softening point of the first coating is higher than that of the second coating. The first coating 26 contains at least 40 weight percent binder resin, based on the total dry ingredients. The first coating contains more binder and less wax than the second coating. The second coating contains at least 40 weight percent wax based on the total dry ingredients. The thermal sensitivity of the first coating 26 and second coating 24 is determined by the melting point of the binder resin and wax and the amount of each therein. The variations in coating composition and melting points are such that exposure to heat from a thermal transfer head will transfer only second coating 24 to a receiving substrate 28. The first coating (subcoating) and functional coating separate upon transfer by exposure to a thermal print head of a thermal printer, forming image 32. It is possible that the second coating (second coating) layer can comprise more than one compatible layer which transfers to form an image but they must be formulated so as to separate from the first coat simultaneously.

The colorants of the first coating and functional coating are typically distinct. The first coating colorants are dark-colored to provide opacity. The functional coating can contain either sensible transparent or semi-transparent dyes or insoluble particles opaque colorants or none of the above. The binder resins in the first coating and second coatings are preferably distinct so as to ensure only the second coating responds and transfers to the receiving substrate upon being heated by a thermal print head. The coatings can be further differentiated by the waxes and (residual) solvents therein and the amounts thereof. This multilayer thermal transfer medium has been found to be advantageous in providing 1) opacity during use so as to be "sensed" by optical sensors of thermal printers and 2) versatility in the second layer since transparent, semi-transparent or opaque second layers can be used. The first coating can also create a non-glossy surface for the second coating (when colored) which causes the second coating to have a matte appearance when applied to a receiving substrate consistent with co-pending U.S. Pat. No. 5,744,226 of Olmstead et al.

The first coating contains a dark-colored colorant, such as carbon black at levels which can be higher than that of the second coating since 1) it is intended that the first coating not transfer and form part of the sensible image and 2) it is intended to render the ribbon opaque. The amount preferably ranges from 15 to 50 weight percent based on the total dry ingredients of the coating and most preferably about 15–40 weight percent of the total dry ingredients of the coating, i.e., about 30 wt. %. Essentially, any dark-colored colorant suitable for use in thermal transfer printing can be employed in the first coating. A preferred colorant is carbon black.

The second coating can contain either sensible transparent or semi-transparent dyes or insoluble particles opaque colored colorants or none of above. Essentially, any sensible transparent or semi-transparent dye or insoluble particles or colorant suitable for use in thermal transfer printing can be employed in the second coating. These include dyes and particles which can be sensed by optical, magnetic or electronic means. However, it is preferable for the second coating to contain a sensible transparent dye or insoluble particles such as a photochromic dye or light colored pigment, such as a yellow colored pigment, to take advantage of the opaque first coating. Suitable examples of sensible transparent dye or insoluble particles include the photochromic dyes and pigments disclosed in co-pending application Ser. No. 08/671,082 (Attorney Docket No. 6847), filed concurrently herewith and assigned to the same assignee as the present invention. The term colorants and sensible transparent dyes as used herein includes colored and colorless organic dyes such as photochromic dyes and those described in U.S. Pat. No. 3,663,278, and leuco dyes which can react with phenolic resins to generate color. The first coating can contain a loading of colorants or sensible transparent dye or insoluble particles higher than the second coating since, unlike the second coating, it is to be sensed by the optical detection means. A distinct loading of colorants and sensible transparent dye or insoluble particles will also help differentiate the two coatings so that they separate and do not transfer simultaneously upon exposure to a thermal print head. Amounts of 0–85 wt % colorants and sensible transparent dye or insoluble particles can be used in the second coating. Most preferably, the second coating contains a colorless or light colored pigment or dye at a level of about 15 to 25 weight percent based on the total weight of dry ingredients of the coating. The second coating may contain high loadings of colorants other than colored pigments such as magnetic pigments or fluorescent pigments for specialized applications.

The binder resin used in the first coating and second coating must be distinct so as to provide distinct softening characteristics. This assists in transfer of only the second coating to a receiving substrate upon application of heat from a thermal print head. The softening/melting point of the binder resin within the first coating is higher than that of the second coating.

The binders have many requirements in addition to providing distinct thermal sensitivities such as providing flexibility or resiliency for the coatings. The binder for the first coating preferably provides high adhesion to the transparent flexible substrate. Latexes such as EC 1052 Latex by Environmental Inks and Coatings has been found to provide significant adhesion to the transparent polyester substrates. The resin binder of the second coating preferably provides high adhesion to the receiving substrate once the second coating is transferred. Suitable binder resins for the first coating and second coatings are well known and include those described in U.S. Pat. Nos. 5,240,781 and 5,348,348. Suitable binder resins include an acrylic acid-ethylene-vinyl acetate terpolymer, methacrylic acid-ethylene-vinyl acetate terpolymer, acrylic acid-ethylene-ethylacetate terpolymer, and other (meth)acrylic acid alkyene alkyl acetate terpolymers, polyvinylchloride, polyvinyl acetate, vinylchloride-vinyl acetate copolymer, polyethylene, polypropylene, ethylene-vinyl acetate copolymer, ethylene-ethyl acetate copolymer, styrene copolymer, nitrile rubber, acrylic rubber, ethylene-propylene rubber, polyurethane resin, ethylene-alkyl (meth)acrylate copolymer, polyvinyl alcohol, and styrene-alkyl (meth)acrylate copolymer. These resins preferably have a softening temperature of from 80° C. to 250° C.

The binder resins can be soluble in water or organic solvents or be dispersible in these solvents. To obtain dispersions, the binder resins are typically used as small particles, typically of submicron size. Each coating may contain more than one binder resin to provide a specific property profile for the resulting coating. For example, Picotex 100 resin by Hercules is a hydrocarbon resin (vinyl toluene-α-methylstyrene copolymer) that provides hot tack properties desirable for the second coating in aiding adhesion to the receiving substrate upon transfer. Another binder resin suitable for the second coating is ethyl vinyl acetate copolymer such as "Elvax 260" by Chemcentral of Atlanta, Ga. With respect to the amount of binder resin, the first coating contains at least 40 weight percent resin binder and preferably from 50 to 80 weight percent resin binder. In contrast, the second coating preferably contains less than 40 weight percent resin binder and most preferably less than 25 weight percent resin binder.

The second coating also contains wax such as hydrocarbon wax, paraffin wax, carnauba wax, etc. Suitable waxes are those used in conventional thermal transfer media including those described in U.S. Pat. No. 5,240,781. Suitable waxes provide temperature sensitivity and flexibility and facilitate transfer of the coating. Examples include natural waxes such as carnauba wax, rice wax, bees wax, lanolin, candelilla wax, motan wax and ceresine wax; petroleum waxes such a paraffin wax and microcrystalline waxes; synthetic waxes such as oxidized wax, ester wax, low molecular weight polyethylene and Fisher-Tropsch wax; higher fatty acids such as lauric acid, myristic acid, palmitic acid, stearic acid and behenic acid; higher aliphatic alcohols such as stearyl alcohol; esters such as sucrose fatty acid esters, sorbitan fatty acid esters and amides. The wax-like substances preferably have a melting point of from 40° C. to 130° C., more preferably 65° C. to 110° C. A particular example of a suitable wax is carnauba wax provided by Shamrock Technologies in Newark, N.J. under the tradename "S-Nauba". Another is "Carnauba North Country No. 3" by Baldini & Co., Inc. of Millburn, N.J.

The first coating may optionally contain a wax and the amount thereof is typically less than that in the second coating. It is preferable to utilize waxes with a higher softening temperature than that of the wax within the second coating to further differentiate the coatings and provide a higher softening temperature for the first coating in general. Suitable waxes for the first coating include those described above including "S-Nauba" by Shamrock Technologies, Inc. referred and also polyethylene wax available from Micro Powders, Inc. of Tarrytown, N.Y. under the tradename "MPP-620XF". The first coating preferably contains less than 45 weight percent wax. In contrast, the first coating contains at least 40 weight percent wax and most preferably from 50 to 85 weight percent wax.

A preferred thermal transfer medium contains a transparent polyester substrate with a first coating comprising from 25 to 85 weight percent pigment, 0 to 45 weight percent wax and 15 to 75 weight percent binder resin. The second coating comprises 15 to 25 weight percent pigment, 50 to 80 percent wax and 5 to 15 weight percent resin binder.

The first coating and second coatings may contain a plasticizer to enhance flexibility and reduce the softening point. Plasticizers used in binders of conventional thermal transfer ribbons such as those described in U.S. Pat. No. 3,663,278 are suitable as are poly(ethylene oxide) homopolymers such as Polyox N10 water soluble resins by Union Carbide. Each layer may contain other optional additives to enhance such properties as flexibility, softening, viscosity and smoothness. These optional additives include plasticizers such as adipic acid esters, phthalic acid esters, chlorinated biphenyls, citrates, epoxides, glycerols, glycols, hydrocarbons, chlorinated hydrocarbons, phosphates, and the like. Other optional additives include flexibilizers such as oil, weatherability improvers such as U.V. light absorbers and fillers.

The thermal transfer medium of the present invention can be produced by a two-layer process wherein the first coating is applied to a transparent flexible substrate such as a polyester film as a first coating and the functional coating is applied over the first coating. As indicated above, the first coating may comprise more than one layer provided they transfer simultaneously. The multiple layers for the second coatings are preferably applied separately. The coating weight of the first coating is preferably maintained between 1 to 5 mg/4 $in^2$ (0.39–1.94 $g/m^2$), the second coating is typically applied at a level from 5 to 15 mg/4 $in^2$ (about 1.94–6 $g/m^2$), preferably 9 to 15 mg/4 $in^2$ (about 3.5–6 $g/m^2$). The polyester film is typically from 18 to 24 gauge; however, the substrates can vary widely and include those described in U.S. Pat. No. 5,348,348. The proportion of binder resin and wax within the coatings can be adjusted to control their softening temperature. Preferred second coatings soften at a temperature in the range of about 50° C. to 250° C. which enables transfer of the first coating at normal print head energies which range from 100° C. to 300° C. and more typically, 200° C. to 300° C. In addition to manipulation of the proportion of binder resin, wax and pigments, additives may be introduced to manipulate the softening point or other properties such as smear resistance, image quality and scratch resistance.

The thermal transfer media of this invention are prepared from formulations that contain the above components in solution or dispersion, typically at about 10 to 60 weight percent solids, preferably 10 to 25 weight percent solids. A portion of the solvent typically remains in the coating applied as residue. The coating formulation can be based on aqueous solvents.

These coating formulations are applied to transparent substrates by conventional techniques and equipment such as Meyer Rod® or like wire round doctor bar set up on a conventional coating machine to provide the coating weights described above. The first coating is typically applied at a temperature higher than the second coating. Once the first coating is applied, it is dried before application of the second coating. The first coating is applied and dried in a similar manner to the first coating. The temperature of the driers are typically in the range of 150° F. to 200° F.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLE 1

A first coating formulation is obtained by preparing the following solution.

First coating Formulation

| Component | Dry % | Wet Batch | Range Dry |
|---|---|---|---|
| Latex[1] | 60 | 150 | 50–80 |
| Carbon Black | 30 | 30 | 5–40 |
| Polyethylene Wax[2] | 10 | 10 | 0–20 |
| Isopropyl Alcohol | — | 310 | — |
| TOTAL | 100 | 500 | |

[1]Latex = "EC 1052 Latex" by Environmental Inks and Coatings, Morganton, NC.
[2]Polyethylene Wax = "MPP-620XF" by Micro Powders, Inc. Tarrytown, NY.

A second coating formulation is obtained by preparing the following solution:

Second coating Formulation #1

| Component | Dry % | Dry Batch | Wet Batch | Range Dry |
|---|---|---|---|---|
| Ethyl Vinyl Acetate Copolymer[3] | 8.3 | 8.3 | 8.3 | 5–15 |
| Carbon Black | 18.0 | 18.0 | 18.0 | 15–25 |
| Carnauba Wax[4] | 5.6 | 5.6 | 5.6 | 0–15 |
| Paraffin Wax[5] | 38.9 | 38.9 | 38.9 | 35–60 |
| Hydrocarbon Wax[6] | 29.2 | 29.2 | 29.2 | 20–40 |
| Mineral Spirits | — | — | 400.0 | — |
| TOTAL | 100.0 | 100.0 | 500.0 | — |
| FINAL SOLIDS % | 16.7 | | FINAL SOLIDS % | 15–30 |

[3]Ethyl Vinyl Acetate Copolymer = "Elvax 260" by Chemcentral, in Atlanta, GA.
[4]Carnauba Wax = "Carnauba North County, Number 3" by Baldini & Co., Inc., in Millburn, NJ.
[5]Paraffin Wax = "Paraffin 1014" by IGI-Boler, in Wayne, PA.
[6]Hydrocarbon Wax = "WB-17" by Petrolite Corp., in Tulsa, OK.

Example 1 of a Thermal Transfer Medium

A thermal transfer medium consistent with the present invention is prepared as follows: A sub-coating is formed on a 4.5 micron polyester film by I. E. DuPont Demeres & Co. having a weight between 0.39–1.94 $g/m^2$ from the first coating Formulation described above. A second coating having a coat weight controlled between 1.94–6 $g/m^2$ is deposited on the first coating from the Second coating Formulation 1 described above. The coated polyester film is dried following the application of each coating to complete the thermal transfer medium.

Example 2 of a Thermal Transfer Medium

A thermal transfer medium consistent with the present invention is prepared from coating formulations consistent with Example 1 wherein the first coating Formulation is as described above and the second coating provides a transparent film and is prepared from Second Coating Formulation #2 described below.

Transparent Second Coating Formulation #2

| Component | Dry % | Weight Dry (g) | Weight Wet (g) |
|---|---|---|---|
| Ethyl Vinyl Acetate Copolymer[1] | 7.0 | 8.4 | 8.4 |
| Photochromic Mixture (117-21-A) | 15.0 | 18.0 | 18.0 |
| Wax[2] | 78.0 | 93.6 | 93.6 |
| Mineral Spirits | — | — | 480.0 |
| TOTAL | 100.0 | 120.0 | 600.0 |
| FINAL SOLIDS % | 16.7 | | 15–30 |

[1]Ethyl Vinyl Acetate Copolymer = "ELVAX 260" by Chemcentral in Atlanta, GA.
[2]Rice Bran Wax obtained from Straht & Pitsch Inc. of West Babylon, NY The preceding examples can be repeated with similar success by substituting the generically or specifically described reactants and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal transfer medium which transfers images to a receiving substrate when exposed to the print head of a thermal printer wherein said thermal transfer medium comprises:

a transparent substrate, a first coating positioned on said transparent substrate having a coat weight of from 0.39–1.94 g/m$^2$ and comprising a dark colored pigment in an amount sufficient to render said thermal transfer medium opaque and at least 40 weight percent of a binder resin, based on dry components; and a second coating positioned on said first coating having a coat weight of from 1.94–6 g/m$^2$ and comprising a binder resin distinct from the binder resin of the first coating, at least 40 weight percent wax, based on the dry components, and optionally a colorant or sensible transparent dye or insoluble particles;

wherein the first coating has a softening point higher than that of the second coating and said first coating does not transfer to a receiving substrate when exposed to the print head of a thermal printer.

2. A thermal transfer medium as in claim 1, wherein the first coating additionally contains wax in an amount less than 20 weight percent, based on dry components and the second coating contains a colorant.

3. A thermal transfer medium as in claim 1, wherein the first coating contains from 15 to 40 weight percent dark-colored pigment, 0 to 45 weight percent wax and 50 to 80 weight percent binder resin based on dry components and the second coating comprises 5 to 25 weight percent sensible transparent dye or insoluble particles, 5 to 15 weight percent binder resin and 60 to 80 weight percent wax based on dry components.

4. A thermal transfer ribbon as in claim 1, wherein the second coating comprises more than one layer which transfers to a receiving substrate when exposed to the thermal print head of a thermal printer.

5. A thermal transfer ribbon as in claim 1, which is sufficiently opaque to be "sensed" within a thermal printer.

6. A thermal transfer ribbon which transfers images to a receiving substrate when exposed to the print head of a thermal printer, said thermal transfer ribbon comprising:

a transparent polyester substrate, a thermally sensitive first coating positioned on said substrate having a coat weight of from 0.39–1.94 g/m$^2$ comprising 15 to 50 weight percent dark-colored pigment, based on dry components, at least 40 weight percent of a binder resin, each based on dry components and from 0 to 20 weight percent wax, based on dry components; and a thermally sensitive, transparent or semi-transparent, second coating positioned on said first coating having a coat weight of from 1.94–6 g/m$^2$ comprising 5 to 25 weight percent of a colorant or sensible transparent dye or insoluble particles; 5 to 15 weight percent binder resin distinct from the binder resin of the first coating and 60 to 80 weight percent wax, each based on dry components;

wherein the first coating has a softening point higher than that of the softening point of the second coating and said first coating does not transfer to a receiving substrate when exposed to the print head of a thermal printer.

7. A thermal transfer ribbon as in claim 6, wherein the binder resin within the first coating adheres to the polyester substrate.

8. A thermal transfer ribbon as in claim 7, wherein the binder resin within the second coating comprises ethyl vinyl acetate copolymer.

9. A thermal transfer ribbon as in claim 6, wherein the solvent for the first coating is water and the solvent for the second coating is mineral spirits.

10. A thermal transfer ribbon as in claim 6, wherein the pigment within the first coating and is carbon black and the colorant or sensible transparent dye or insoluble particles in the second coating is a photochromatic dye or a yellow pigment or dye.

11. A thermal transfer ribbon as in claim 6, wherein the second coating comprises more than one layer which transfers to a receiving substrate when exposed to the thermal print head of a thermal printer.

12. A thermal transfer ribbon as in claim 6, which is sufficiently opaque to be "sensed" within a thermal printer.

13. A thermal transfer ribbon which transfers images to a receiving substrate when exposed to the print head of a thermal transfer printer which comprises:

a transparent polyester substrate;

a thermally sensitive first coating positioned on said substrate having a coat weight of from 0.39 to 1.3 g/m$^2$ and comprising 15 to 40 weight percent carbon black, based on dry components, 0 to 20 weight percent carnauba wax, based on dry components, 0 to 20 weight percent polyethylene wax, based on dry components, and 15 to 85 weight percent latex binder resin based on dry components; and a transparent second coating positioned on said first coating having a coat weight of from 1.3 g/m$^2$ to 6 g/m$^2$ comprising 15 to 25 weight percent sensible transparent dye or insoluble particles pigment, 0 to 15 weight percent carnauba wax, 30 to 60 weight percent paraffin wax and 20 to 40 weight percent hydrocarbon wax and 5 to 15 weight percent ethyl vinyl acetate copolymer, each based on dry components and an organic solvent;

wherein the first coating has a softening point higher than the second coating so as to provide for transfer of only the second coating to a receiving substrate upon exposure to a thermal print head operating at a temperature in the range of 200° C. to 300° C.

14. A thermal transfer ribbon as in claim 13, which is sufficiently opaque to be "sensed" within a thermal printer.

* * * * *

UNITED STATES PATENT AND TRADEMARK OFFICE

CERTIFICATE OF CORRECTION

PATENT NO. : 5,824,399

DATED : October 20, 1998

INVENTOR(S) : Jeffery S. Denton et al.

It is certified that error appears in the above-indentified patent and that said Letters Patent is hereby corrected as shown below:

Column 10, line 19, delete "and" first occurrence.

Signed and Sealed this

Twenty-fifth Day of May, 1999

*Attest:*

Q. TODD DICKINSON

*Attesting Officer*

*Acting Commissioner of Patents and Trademarks*